US006611210B2

(12) United States Patent
Hilliard et al.

(10) Patent No.: US 6,611,210 B2
(45) **Date of Patent: *Aug. 26, 2003**

(54) AUTOMOTIVE VEHICLE CLASSIFICATION AND IDENTIFICATION BY INDUCTIVE SIGNATURE

(75) Inventors: Steven R. Hilliard, Knoxville, TN (US); Geoffrey W. Hilliard, Signal Mountain, TN (US)

(73) Assignee: Inductive Signature Technologies, Inc., Knoxville, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/079,297

(22) Filed: Feb. 18, 2002

(65) Prior Publication Data

US 2002/0154032 A1 Oct. 24, 2002

Related U.S. Application Data

(63) Continuation-in-part of application No. 08/982,743, filed on Dec. 2, 1997, now Pat. No. 6,417,784.

(60) Provisional application No. 60/032,182, filed on Dec. 3, 1996.

(51) Int. Cl.[7] ..... G08G 1/01

(52) U.S. Cl. ..... 340/941; 340/933; 340/906; 340/917; 701/23; 701/117

(58) Field of Search ..... 340/902, 903, 340/904, 905, 907, 933, 939, 991, 992, 993, 996, 10.1, 825.71, 941, 917; 455/41, 54, 55, 99; 701/23, 117

(56) References Cited

U.S. PATENT DOCUMENTS

| | | | | | |
|---|---|---|---|---|---|
| 4,302,746 | A | * | 11/1981 | Scarzello et al. | 340/938 |
| 4,449,115 | A | * | 5/1984 | Koerner | 340/941 |
| 4,939,484 | A | * | 7/1990 | Harada | 333/24 R |
| 5,508,698 | A | * | 4/1996 | Hockman | 340/936 |
| 5,523,753 | A | * | 6/1996 | Fedde et al. | 340/941 |
| 5,705,999 | A | * | 1/1998 | West et al. | 340/941 |
| 5,751,225 | A | * | 5/1998 | Fedde et al. | 340/941 |
| 6,342,845 | B1 | * | 1/2002 | Hilliard et al. | 340/941 |
| 6,380,868 | B1 | * | 4/2002 | Hilliard et al. | 340/941 |
| 6,417,784 | B1 | * | 7/2002 | Hilliard et al. | 340/941 |

* cited by examiner

*Primary Examiner*—Daryl Pope
(74) *Attorney, Agent, or Firm*—Pitts & Brittian, P.C.

(57) ABSTRACT

A wire-loop vehicle detector is configured with a vertically oriented blade aligned at an angle to the direction of traffic-flow with each end of the blade extending laterally beyond the normal limits of vehicle presence over the blade. The extended blade configuration of the wire-loop constrains over-passing vehicles to present repeatable inductive signatures while electromagnetic noise and thermal-drift are selectively canceled using a secondary coil to increase the signal-to-noise ratio of inductance measurements. Inductive signatures of vehicles are recorded using a high-speed and high-precision method of making multiple successive measurements of the inductance of a wire-loop as vehicles pass over. Inductive signatures of automotive vehicles are useful for parking-lot revenue control, car-bomb detection, passive security of isolated communities, and other traffic-flow monitoring and control applications.

21 Claims, 17 Drawing Sheets

AUTOMOTIVE VEHICLE CLASSIFICATION AND IDENTIFICATION BY INDUCTIVE SIGNATURE

CLAIM OF PRIORITY

Priority is claimed by reference to co-pending U.S. provisional patent application No. 60/032,182.

FIELD OF THE INVENTION

The present invention generally relates to the measurement of induction, and more particularly to inductive vehicle detectors and their applications.

DESCRIPTION OF THE PRIOR ART

Metal detectors are widely used to locate metallic objects that are buried or otherwise hidden from view in military, forensic, geological prospecting, archaeological exploration, and recreational treasure-hunting applications. They have many industrial uses including proximity and position sensing, and the automated inspection of manufacturing, assembly, and shipping processes. They are the active component in pedestrian screening devices used at airports and other high-security areas to detect the presence of concealed weapons. Inductive vehicle detectors are widely deployed on highways and at intersections for traffic-flow monitoring and control, and at parking facilities for revenue control and access control.

The measurable inductance of a wire-loop is directly proportional to the magnetic permeability of the space surrounding the loop. Non-metallic matter typically has no measurable effect on the magnetic permeability of the space it occupies, while metallic matter can measurably increase or decrease the magnetic permeability of the space it occupies depending on its composition. It is well known in the prior-art to measure the inductance of a wire-loop to detect the presence or absence of metal near the loop. The presence of iron tends to increase the inductance of a wire-loop, while the presence of non-ferrous metal tends to decrease the inductance of a wire-loop.

The variation of inductance typically observed in vehicle detectors of the prior-art is on the order of two-percent of the nominal inductance of the wire-loop, while the electromagnetic noise and thermal drift affecting the wire-loop is of approximately the same order of magnitude. Major identifiable sources of electromagnetic noise include electrical power lines, computing and communications equipment, automotive ignition systems, and cross-talk between wire-loops when two or more sensors are deployed in close proximity to one another.

Prior-art wire-loops are deployed in a plane which is roughly parallel to the surface of the roadway into which they are embedded, and the wire-loops are positioned and shaped so that the variation in the inductance of the wire-loop caused by over-passing vehicles is maximized, while uncertainties due to electromagnetic noise is minimized. Prior-art wire-loops are typically deployed with a rectangular geometry comprising four wire legs. The magnetic field generated by a current flowing in a wire is described by the Biot-Savart law of physics, and is known to form roughly a cylindrical magnetic field around each leg of a wire-loop with a field intensity which diminishes linearly with increasing radial distance from the wire. The two cylindrical magnetic fields produced by opposing legs of a wire-loop tend to cancel each other out with the effect being that the farther the two legs are separated in space, the stronger the composite magnetic field will be above the wire-loop where vehicles are to be detected. However, the vulnerability of the wire-loop to electromagnetic noise also increases as the legs of the wire-loop are separated from each other which results in a generally poor signal-to-noise ratio. Prior-art detectors which are able to reliably detect passenger cars are unable to reliably detect motorcycles, snowplows, large trucks, and other vehicles with high ground clearance because of the uncertainty imposed by ambient electromagnetic noise and temperature drift. In addition to reducing traffic-flow efficiency, this can lead to property damage and personal injury caused by automated parking gates which prematurely close on vehicles having high ground clearance.

The techniques of the prior-art which tend to maximize the signal-to-noise ratio of wire-loops by widely separating the four legs of the loops, and deploying the loop so that the vehicles are detected by all four legs of the loop simultaneously, also tend to destroy the potential of the wire-loops for providing repeatable inductive signatures of detected vehicles because the vehicles are not constrained to pass over the wire-loop in the same way every time. Vehicles passing over prior-art wire-loops at different angles and different lateral offsets to the wire-loop necessarily produce inductive signatures which are different. In order to use an inductive signature of a vehicle to classify or identify the vehicle, it is desirable to constrain the vehicle to produce an inductive signature which is as nearly repeatable as possible. In addition, because it is desirable for vehicles to eclipse the magnetic fields of all four legs of prior-art wire-loops simultaneously, these wire-loops are often designed to be relatively narrow and therefore forfeit the strong signals produced by wheel rims.

In the prior-art, the inductance of a wire-loop is measured by making the wire-loop part of a free-running oscillator circuit which has a frequency determined by the inductance and resistance of the wire-loop. A frequency-counter then counts the number of charge-discharge cycles of the oscillator over a pre-determined period of time. This count is partially a function of the varying inductance of the wire-loop, but also varies with electromagnetic noise and thermal drift. A temperature change in the wire-loop of only 6-degrees Centigrade would typically cause a baseline drift equal to the full-scale of the inductance variations being measured because the resistance of the wire in the wire-loop is temperature dependent.

U.S. Pat. No. 5,523,753 cancels some of the low-frequency components of the electromagnetic noise which are predictably generated by power-lines and which have a basically periodic nature. Low-frequency noise is amplified, high-frequency noise is unaffected, and only 60 inductance measurements per second may be made using this technique. The "time-aperture" of the detector is open for an entire 16.7 ms of each sample which is undesirable for making precision measurements of rapidly varying inductance; the "time-aperture" of the detector is the time during which a change in the inductance being measured will cause a change in the inductance measurement.

U.S. Patent No. 5,491,475 describes the use of magneto-resistive sensors having the capability of distinguishing different magnetic signatures of basic vehicle types. The disclosed magnetometers do not constrain over-passing vehicles to present repeatable signatures which renders them useless for precise vehicle classification and identification applications, and the sensors are shown to be sensitive to vehicles in adjacent traffic lanes which introduces an added element of uncertainty into any signatures recorded. Magnetometers may be used in combination with wire-loops of the present invention where appropriate.

The length of prior-art wire-loops is limited in practice because the loops typically enclose a quantity of pavement material which would tend to destroy larger wire-loops over time due to thermal expansion.

SUMMARY OF THE INVENTION

The present invention may be substituted for prior-art metal detectors in any of the previously known applications, and new applications for metal detectors are made possible by the increased speed, precision, and repeatability of inductance measurements characteristic of the present invention. In particular, a wide variety of intelligent traffic-flow monitoring and control applications are now feasible.

Identifying or classifying vehicles by inductive signature is useful in many applications including parking-lot revenue control, screening traffic-flow for potential car-bombs, passive security of restricted communities, and traffic-flow monitoring and control in general.

The capability of making high-precision measurements of the velocity of vehicles traveling on a highway combined with the capability for classification and unique identification of selected vehicles is useful in traffic-law enforcement applications such as the automated screening of traffic-flow for vehicles operating at excessive speeds.

It is a first object of the present invention to provide a wire-loop configuration for vehicle detection which constrains over-passing vehicles to present a substantially repeatable inductive signature.

It is a second object of the present invention to maximize the identifying information contained within an inductive signature.

It is a third object of the present invention to increase the signal-to-noise ratio of induction measurements made of a wire-loop used for vehicle detection.

It is a fourth object of the present invention to measure the inductance of a wire-loop used for vehicle detection in a relatively short period of time with relatively high-precision by a method which is serially repeatable and substantially independent of preceding and succeeding measurements.

It is a fifth object of the present invention to record an inductive signature of an automotive vehicle by making a plurality of successive measurements of the inductance of a wire-loop while the automotive vehicle overpasses the wire-loop.

It is a sixth object of the present invention to provide a configuration of two or more wire-loops for vehicle detection which have an improved capacity to resolve velocity and acceleration profiles of over-passing vehicles.

It is a seventh object of the present invention to use velocity and acceleration profiles of over-passing vehicles to compensate, or normalize, for distortions of the inductive signatures recorded for those vehicles.

It is an eighth object of the present invention to correlate the normalized inductive signature of an unknown vehicle with the normalized inductive signature of a known vehicle to determine if the known vehicle and the unknown vehicle are of the same classification.

It is a ninth object of the present invention to correlate the normalized inductive signature of an unknown vehicle with the normalized inductive signature of a known vehicle to determine if the known vehicle and the unknown vehicle are the same vehicle.

It is a tenth object of the present invention to correlate a sequence of characteristic point magnitudes from an inductive signature of an unknown vehicle with a sequence of characteristic point magnitudes from an inductive signature of a known vehicle to determine if the known vehicle and the unknown vehicle are of the same classification.

It is an eleventh object of the present invention to provide a wire-loop configuration for vehicle detection which substantially overcomes the practical limitations on the length of wire-loops deployed within roadway surfaces.

It is a twelfth object of the present invention to provide a wire-loop configuration for vehicle detection which requires less effort to install and maintain within existing roadway surfaces.

These and other objects of the invention are achieved with an extended blade-type wire-loop configuration for vehicle detection; by cancellation of a large fraction of the electromagnetic noise and thermal drift affecting the wire-loop; and with a high-speed and high-precision method of making a plurality of successive discrete measurements of the inductance of the wire-loop while an automotive vehicle overpasses the wire-loop.

DESCRIPTION OF THE PREFERRED EMBODIMENT OF THE INVENTION

Figure 1A:
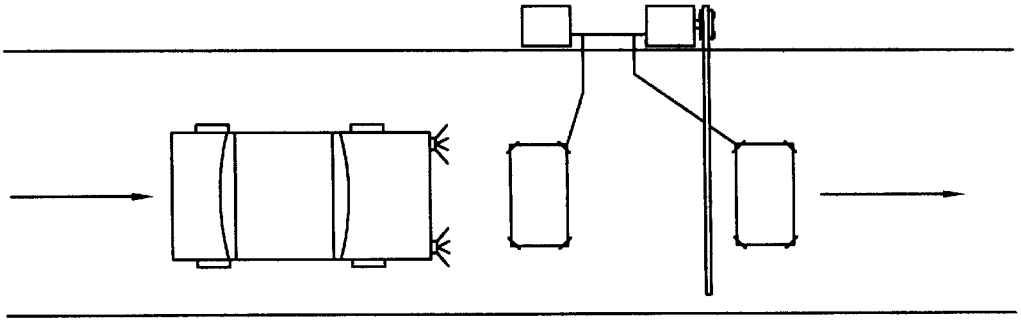
FIG. 1*a* is an overhead view of a typical automated entrance to a parking lot utilizing wire-loops of the prior-art to control the dispensing of tickets and closure of the automatic gate.
Figure 1B:
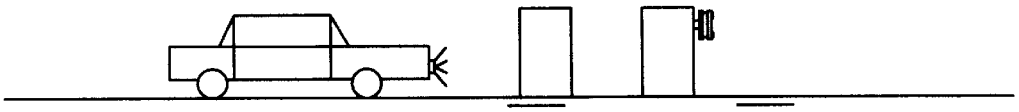
FIG. 1*b* is a side-view of a typical automated entrance to a parking lot utilizing wire-loops of the prior-art to control the dispensing of tickets and closure of the automatic gate.
Figure 2A:
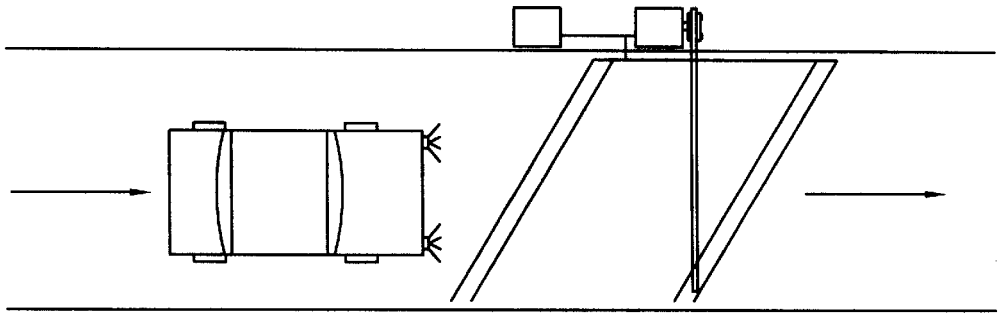
FIG. 2*a* is an overhead view of a typical automated entrance to a parking lot utilizing extended blade-type wire-loops of the present invention to control the dispensing of tickets and closure of the automatic gate while recording the vehicle inductive signature.
Figure 2B:
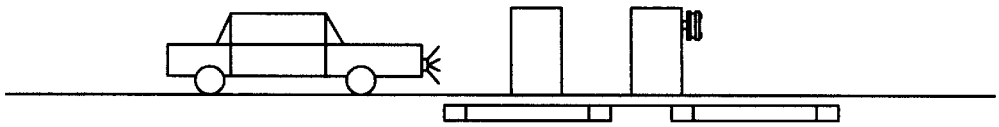
FIG. 2*b* is a side-view of a typical automated entrance to a parking lot utilizing extended blade-type wire-loops of the present invention to control the dispensing of tickets and closure of the automatic gate while recording the vehicle inductive signature.
Figure 3:
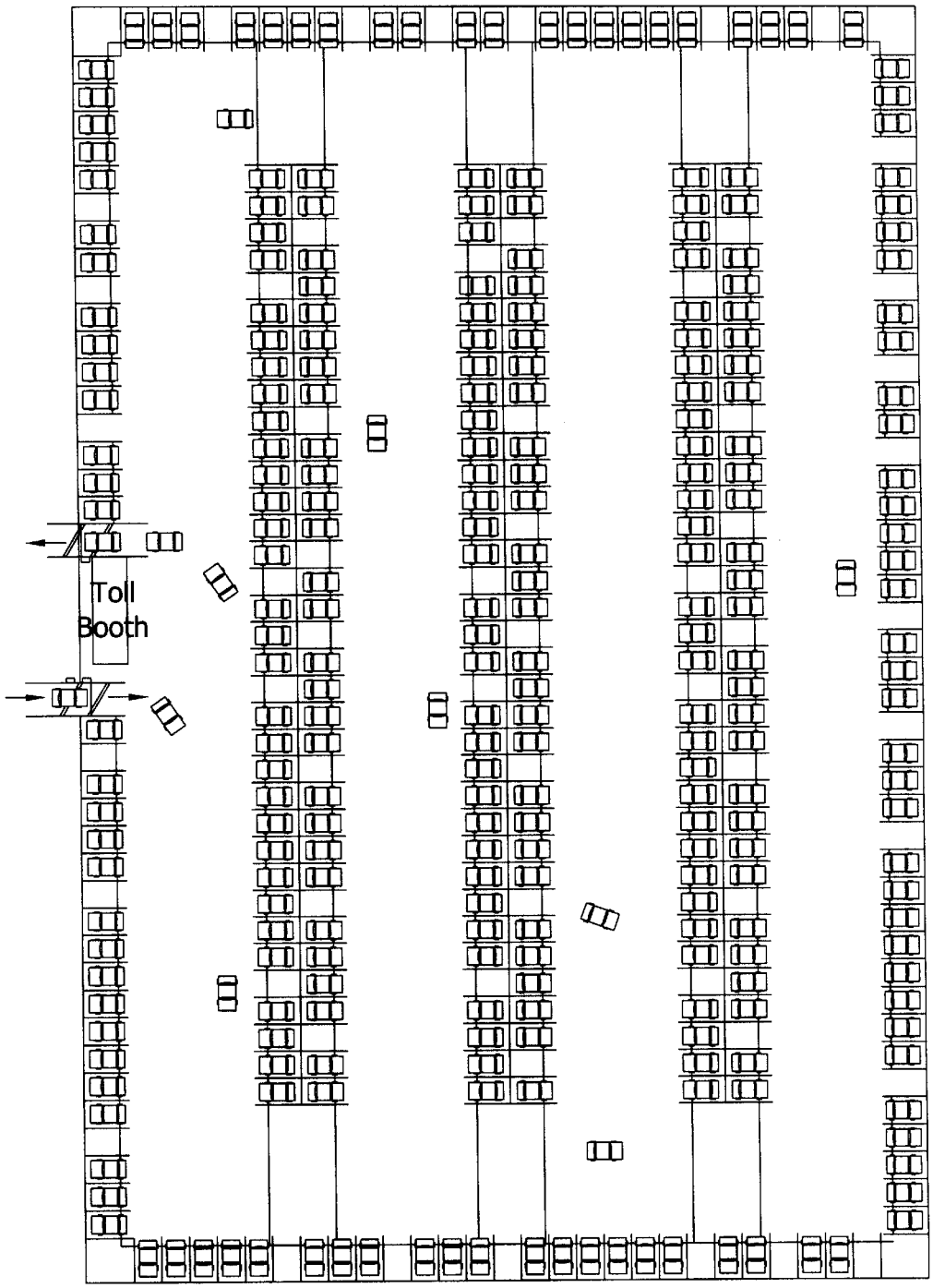
FIG. 3 illustrates how wire-loops of the present invention may be used in a parking-lot to monitor vacancies on each row of cars, and to effect an automated inventory of the cars parked on each row.
Figure 4:
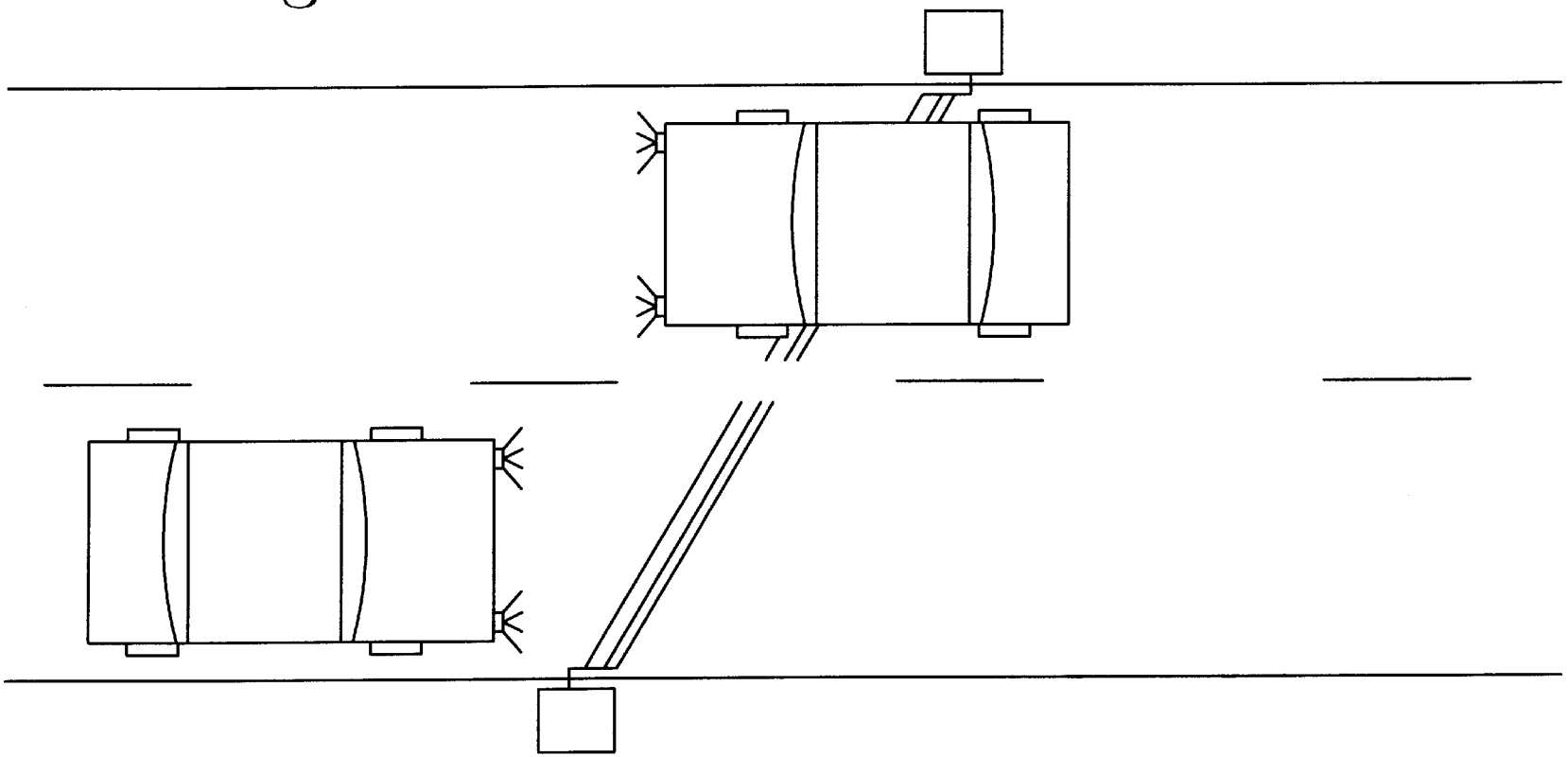
FIG. 4 illustrates how extended wire-loops of the present invention in combination with a means to measure the weight on each of a passing vehicle's tires may be configured to collect data useful for the detection of a car-bomb carried by the vehicle.
Figure 5:
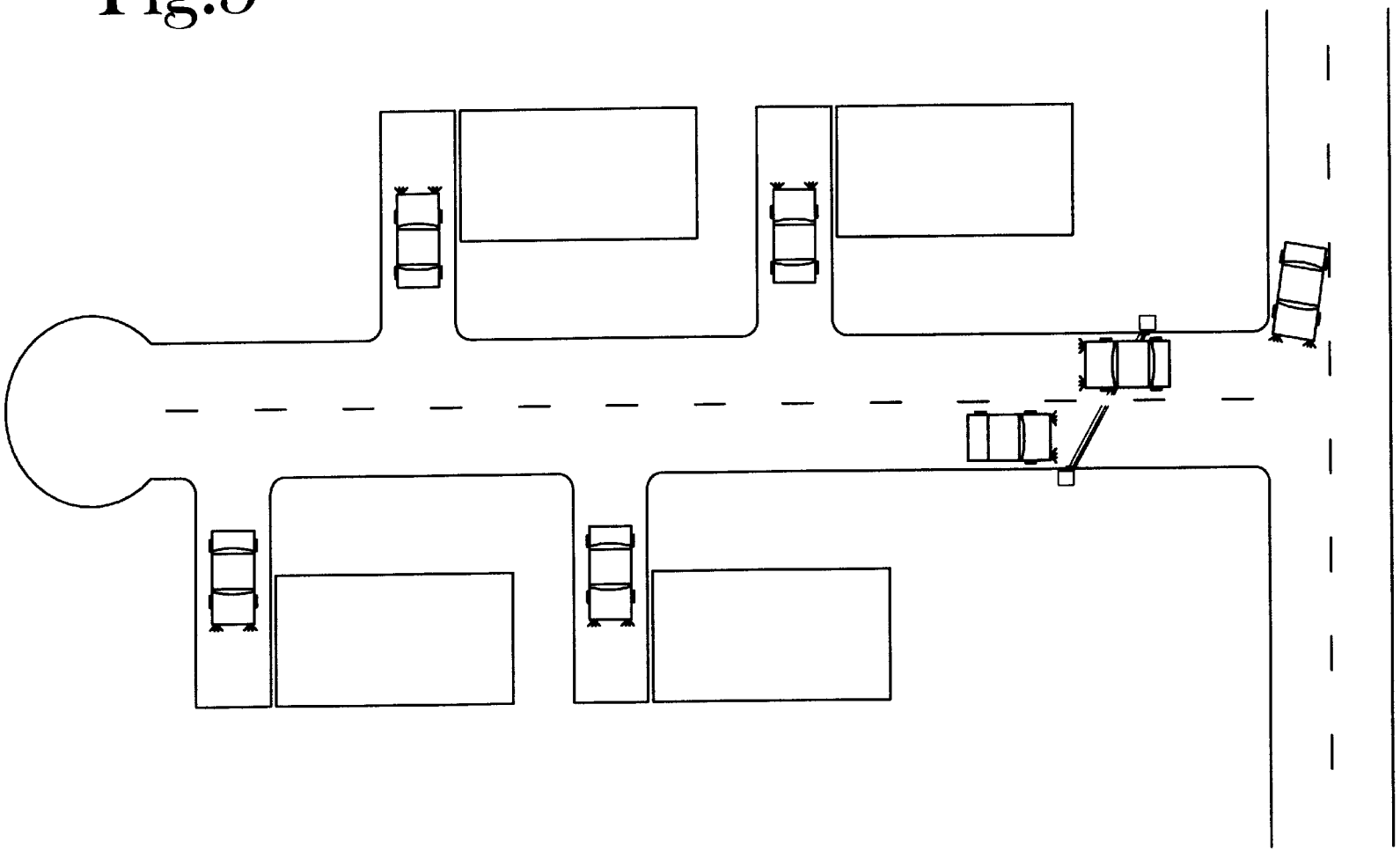
FIG. 5 illustrates how wire-loops of the present invention may be configured to monitor vehicles entering and exiting a restricted community for the purpose of aiding in crime-prevention and investigation of criminal incidents.
Figure 6:
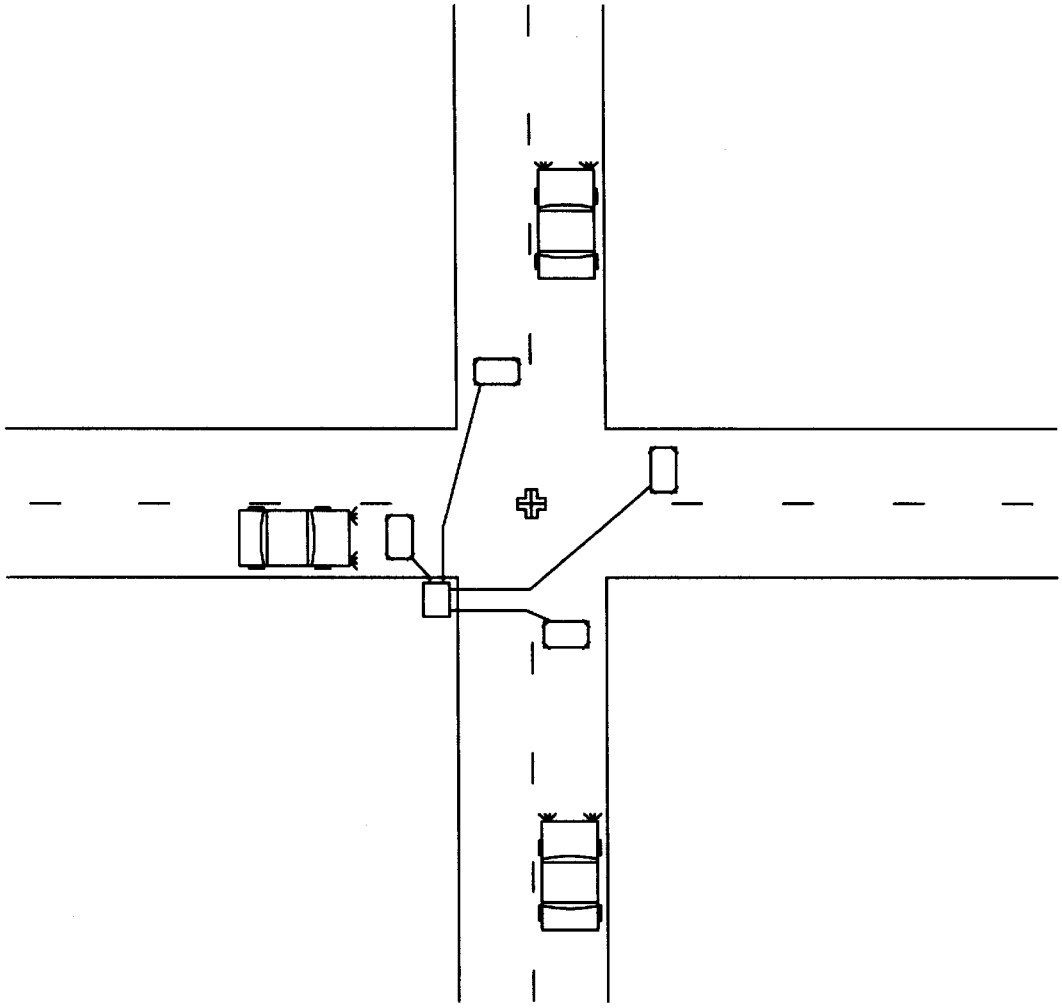
FIG. 6 illustrates a typical four-lane controlled intersection utilizing wire-loops of the prior-art to control the timing of the traffic signal.
Figure 7:
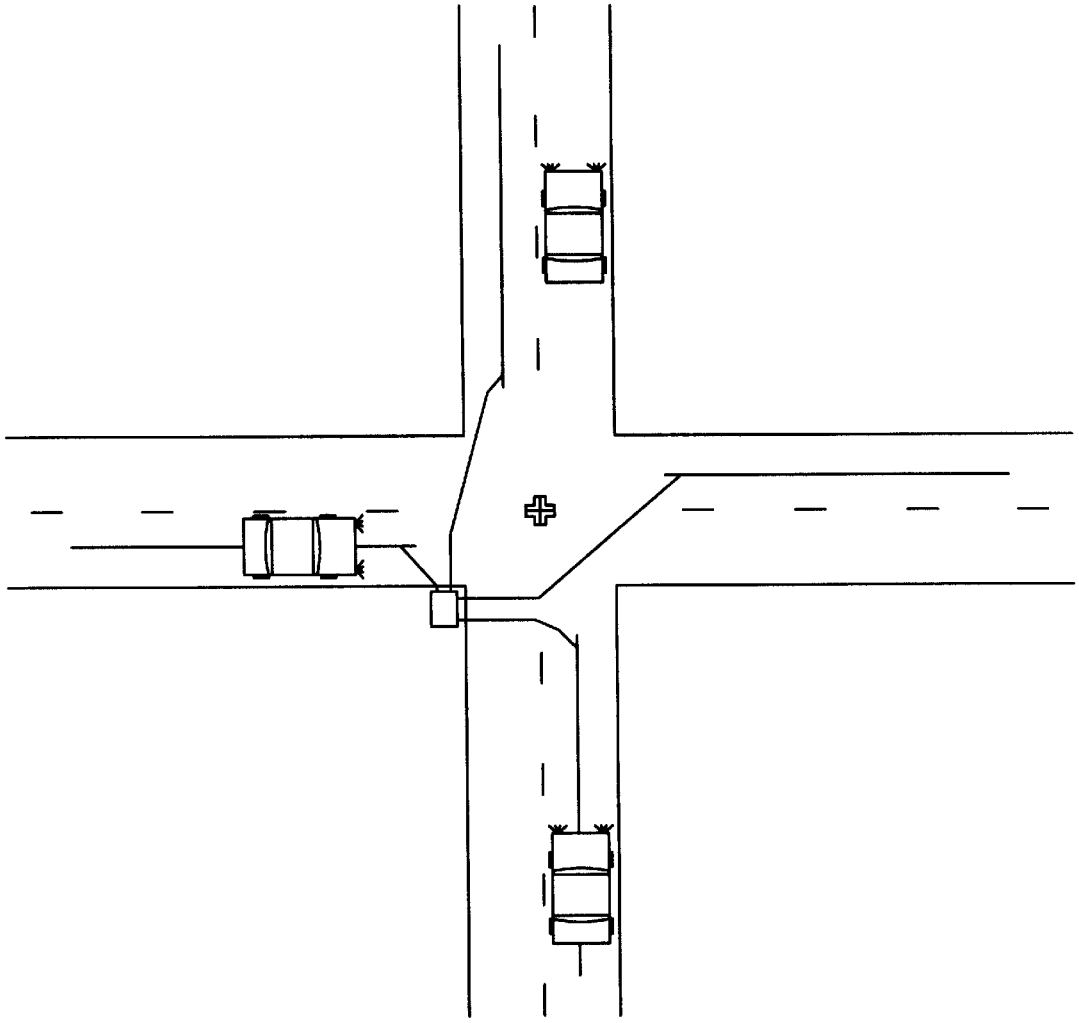
FIG. 7 illustrates a typical four-lane controlled intersection utilizing wire-loops of the present invention to control the timing of the traffic signal.

In the preferred embodiment of the present invention, detected vehicles traveling in a traffic lane are constrained to present repeatable inductive signatures to a wire-loop positioned in the traffic lane when the vehicles pass over the wire-loop by extending the width of the wire-loop on both sides of the traffic lane beyond the width of the typical vehicle. In one-way traffic lanes, the information available from the extended wire-loop is maximized by orienting the extended wire-loop at an angle to the direction of traffic flow so that each wheel of the vehicle is detected separately as it rolls over the extended wire-loop. This orientation of the extended wire-loop tends to maximize the repeatability of the vehicle's inductive signature and the identifiable peaks on the signature which are useful for distinguishing the detected signature from other detected signatures. 60-degrees is suggested as a typical angular offset from the direction of travel for the extended wire-loop, but significant deviations from this suggested angle would still provide acceptable results. At one extreme, a 90-degree angular offset from the direction of travel would tend to obscure some of the information available from the inductive signature of a typical automobile because both front wheels would cross the extended wire-loop simultaneously as would both rear wheels. With a 60-degree offset each of the four wheels produces a corresponding peak in the signature which improves the identifying quality of the signature. Variations in the wheels and tires of automobiles are useful for distinguishing between vehicles of the same make and model. At the other extreme, a 0-degree angular offset from the direction of travel provides an inductive signature which is virtually useless for vehicle classification or identification, but which could be useful for estimating the number of vehicles waiting in a lane of traffic stopped at a controlled intersection.

In the preferred embodiment of the present invention, a new wire-loop configuration called a blade-type wire-loop is used to increase the signal-to-noise ratio of the vehicle detector, and to increase the information available in inductive signatures. This is accomplished by orienting the plane of the wire-loop substantially perpendicular to the plane of the pavement into which it is embedded as opposed to being parallel with the pavement. In pre-existing pavement, a single slot is sawed into the pavement into which the blade-type wire-loop is to be embedded. The blade-type wire-loop is wound or plated onto a form, typically plastic, and is preferably pre-fabricated, but may be fabricated at the point of installation. The blade-type wire-loop is inserted into the slot made in the pavement and the slot is weather-sealed as is typical for other wire loops. It is preferable that the pavement be flat, and that the horizontal dimension of the blade-type wire-loop be parallel with the pavement; but a flexible blade-type wire-loop may be made to conform to the horizontal contour of the pavement into which it is inserted. No pavement material need be enclosed by the blade-type wire-loop, and therefore the thermal expansion of the pavement need not constrain the length of the wire-loop. Longer blade-type wire-loops are useful at traffic intersections to more accurately estimate the number of vehicles waiting in each lane so that traffic flow may be facilitated more efficiently. Longer blade-type wire-loops are also useful in parking lots to monitor traffic-flow, available spaces, and to perform automated inventory of vehicles resident vs. spaces available on entire rows of cars. Extended blade-type wire-loops provide the combined benefits of the blade-type wire-loop and the extended wire-loop.

The blade-type wire-loop may be configured with virtually any desired depth, but shallower depths on the order of a few centimeters are most convenient to install and have the added benefit of allowing most of the incident electromagnetic noise to be canceled within the blade-type wire-loop itself; signal-to-noise ratio decreases with depth. An extended blade-type wire-loop having a length of three meters, a depth of eight centimeters, a width of three millimeters, and two matched single-turn coils of #29 nylon-insulated copper wire wrapped on a plastic form and oriented approximately 60-degrees from the direction of vehicle travel is recommended as a suitable configuration for monitoring a single-lane of traffic. However, a wide variety of variations of this suggested configuration may be made while still falling within the scope of the present invention.

For installation in existing roadway surfaces, wire-loops of the prior-art typically require eight saw-cuts in the roadway surface for the loop itself in addition to saw-cuts to route wires from the loop to the control circuitry. The blade-type wire-loop of the present invention typically requires only one saw-cut for each wire-loop in addition to the saw-cuts needed to route wires from the loop to control circuitry. Because the wires of the blade-type wire-loops do not typically enclose any pavement material, thermal expansion of the pavement has less opportunity to break the wires of the loop and maintenance costs are reduced as reliability is increased.

For installation prior to the laying-down of a roadway surface, the plane of the blade-type wire-loop may be oriented either substantially parallel or substantially perpendicular to the plane of the roadway surface; though perpendicular orientation is strongly preferred. The perpendicular, or vertical, orientation of the blade-type wire-loop is most useful for installation into existing roadway surfaces in addition to providing the sharpest "physical aperture" for the detector. The vertical orientation of the blade-type wire-loop has the best signal-to-noise ratio because the magnetic field of the lowered-leg of the wire-loop interacts less strongly with the vehicle being detected since it has been moved farther away from the vehicle.

Figure 8:
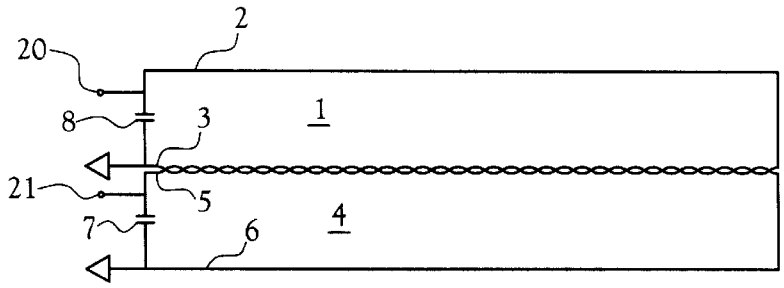
FIG. 8 depicts a typical physical layout of a pair of LCR circuits used in a wire-loop vehicle detector of the preferred embodiment of the present invention.

Referring to FIG. 8 in the drawings, the blade-type wire-loop, 1, typically has two horizontal legs, 2 and 3, which extend across the traffic lane, and the vertical orientation places the upper-horizontal leg, 2, nearer to the surface of the pavement than the lower-horizontal leg, 3. The magnetic field generated by the upper-horizontal leg, 2, of the wire-loop, 1, interacts more strongly with over-passing vehicles than the magnetic field generated by the lower-horizontal leg, 3, of the wire loop, 1. The difference between these two magnetic fields interacting with an over-passing vehicle is detectable as a point of an inductive signature, and it is desirable to maximize the repeatable difference between these two interactions; detectable differences which are not repeatable are considered to be noise and are undesirable.

Figure 9:
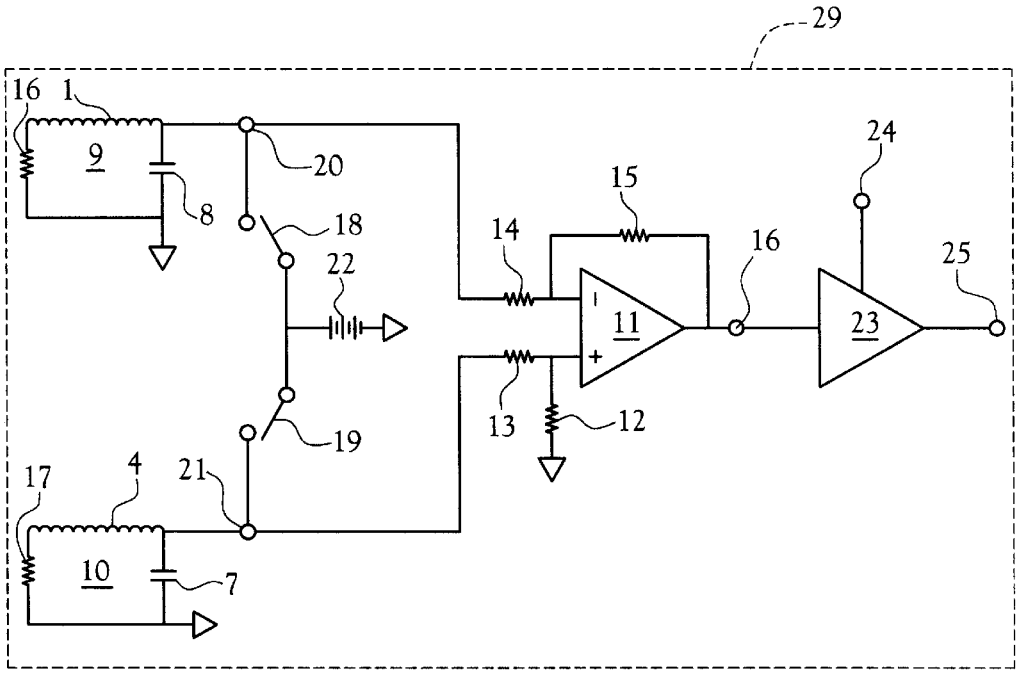
FIG. 9 is a schematic diagram of an analog output (LCR—LCR) inductance measurement circuit typical of the preferred embodiment of the present invention.

Wire-loops act as antennas which naturally receive undesirable electromagnetic noise that introduces a degree of uncertainty into each inductance measurement made. Also, even a small change in the temperature of a wire-loop causes a significant change in the resistance of the wire-loop which is difficult to distinguish from the inductance changes which are being measured. In the preferred embodiment of the present invention, a second wire-loop, 4, designated as the "secondary-loop", is positioned below the first wire-loop, 1, designated as the "primary-loop" for the purpose of reducing the uncertainties in the measurement of inductance caused by electromagnetic noise and thermal drift. An added benefit known as common-mode rejection is also available with the addition of the secondary loop, but this could also be accomplished in other ways. To maximize signal-to-noise ratio, it is preferred that the two loops, 1 and 4, are coplanar and of like dimensions, and significantly differ only in that the secondary-loop, 4, is positioned directly underneath the primary-loop, 1, with respect to the surface of the pavement into which the vehicle detector is embedded. Because current-carrying wires in close proximity naturally exert significant forces on one another, the lower-horizontal leg, 3, of the primary-loop, 1, and the upper-horizontal leg, 5, of the secondary-loop, 4, should be firmly anchored with respect to one another, and may be twisted together. Though simple inductance-resistance (LR) circuits are perfectly feasible, in the preferred embodiment of the present invention capacitors, 7 and 8, are attached to each of the two wire-loops, 1 and 4 respectively, to form two closely matched LCR oscillator circuits, FIGS. 9—9 and 10 respectively. Three important functions are performed by the addition of the secondary LCR circuit, 10; common-mode rejection, noise cancellation, and thermal-drift compensation. It is possible to operate the two LCR circuits, 9 and 10, in series with each other to achieve common-mode rejection without an instrumentation-type amplifier configuration, 11–16, thermal-drift compensation, and a degree of noise cancellation; but this is not recommended because though −40 dB of electromagnetic noise attenuation is achievable at power-line frequencies, this performance is seriously degraded or nonexistent at higher frequencies. Parallel operation of the matched LCR circuits, 9 and 10, is recommended because it provides common-mode rejection using an instrumentation amplifier configuration, 11–16, thermal-drift compensation, and an estimated −40 dB noise attenuation at all pertinent frequencies. The addition of the matched secondary LCR circuit, 10, is so effective at noise cancellation, that the noise-floor of the best available op-amp, 11, operating at ambient temperature becomes the limiting factor for the signal-to-noise performance of the detector. In special applications where ultimate performance is required, the full signal-to-noise potential of the matched LCR circuits may be realized by using a cryogenically cooled instrumentation amplifier, 11–16, which has been designed for low temperatures. When two wire-loops are used as described, the net magnetic field interaction measured is substantially that of the upper-horizontal leg, 2, of the primary loop, 1, minus the lower-horizontal leg, 6, of the secondary loop, 4.

Figures 10A, 10B, 10C, 10D, 10E, 10F:
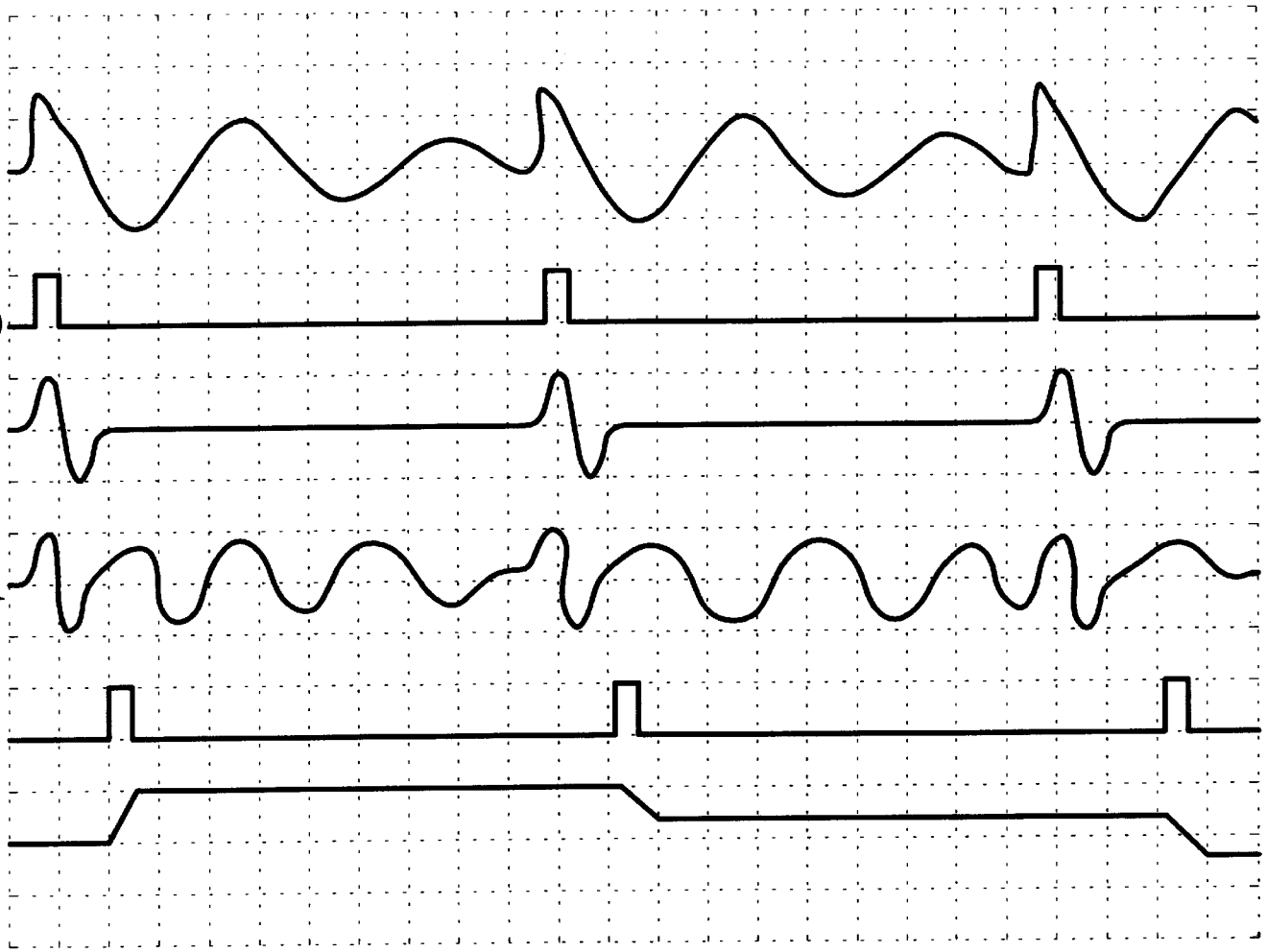
FIG. 10*a* illustrates a typical oscilloscope trace of the repeating charge and discharge cycle for the LCR oscillator circuits of the present invention.
FIG. 10*b* illustrates typical logic pulse timing which controls the switches gating the charging current to the LCR circuits in the preferred embodiment of the present invention.
FIG. 10*c* illustrates typical output of the instrumentation amplifier when no metal is detected by the wire-loop.
FIG. 10*d* illustrates typical output of the instrumentation amplifier when metal is detected by the wire-loop.
FIG. 10*e* illustrates typical timing of the logic pulse which triggers the sample-and-hold amplifier that samples the instrumentation amplifier output.
FIG. 10*f* illustrates typical output of the sample-and-hold amplifier when metal, which is in motion relative to the wire-loop, is being detected.
Figure 11:
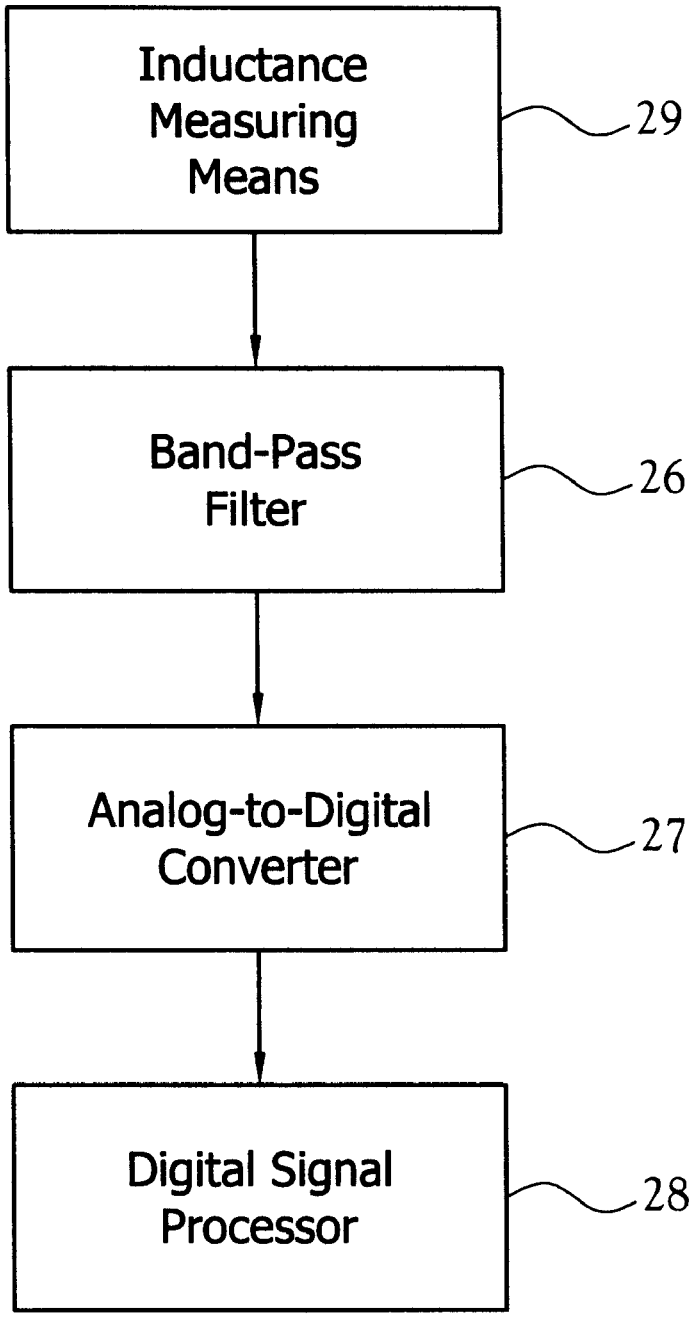
FIG. 11 illustrates the basic flow of data within a typical data acquisition system employing inductive vehicle detectors of the present invention.
Figure 12:
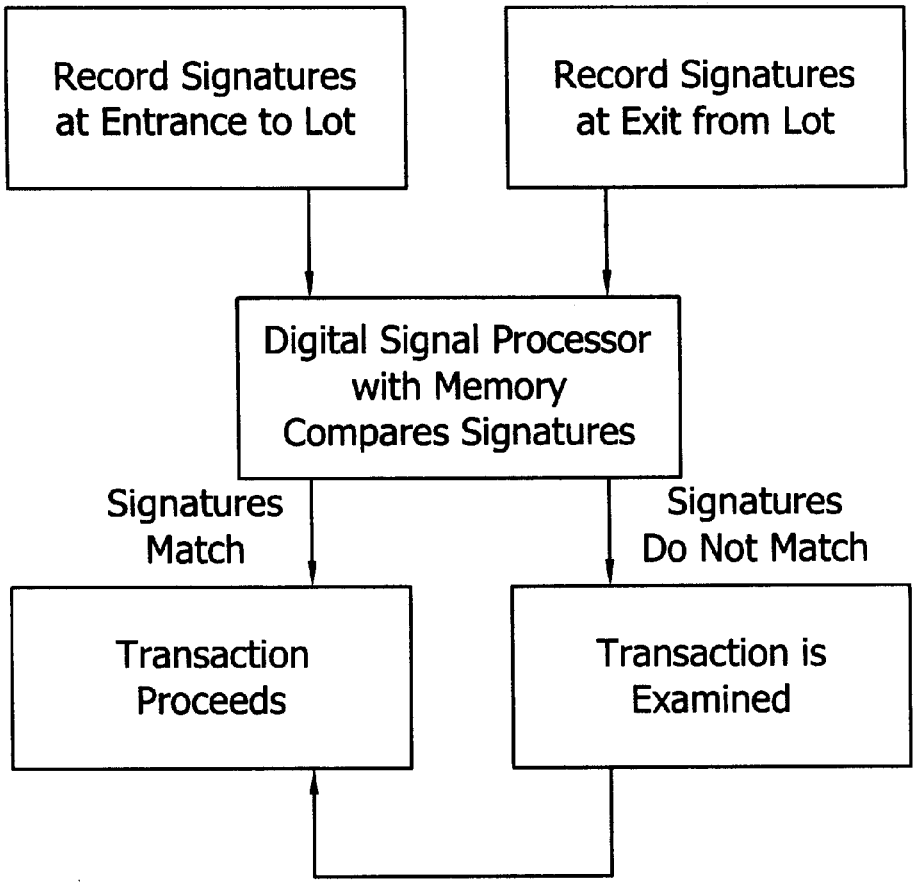
FIG. 12 is a block diagram of a typical parking-lot revenue control application using inductive vehicle detectors of the present invention.
Figure 13A:
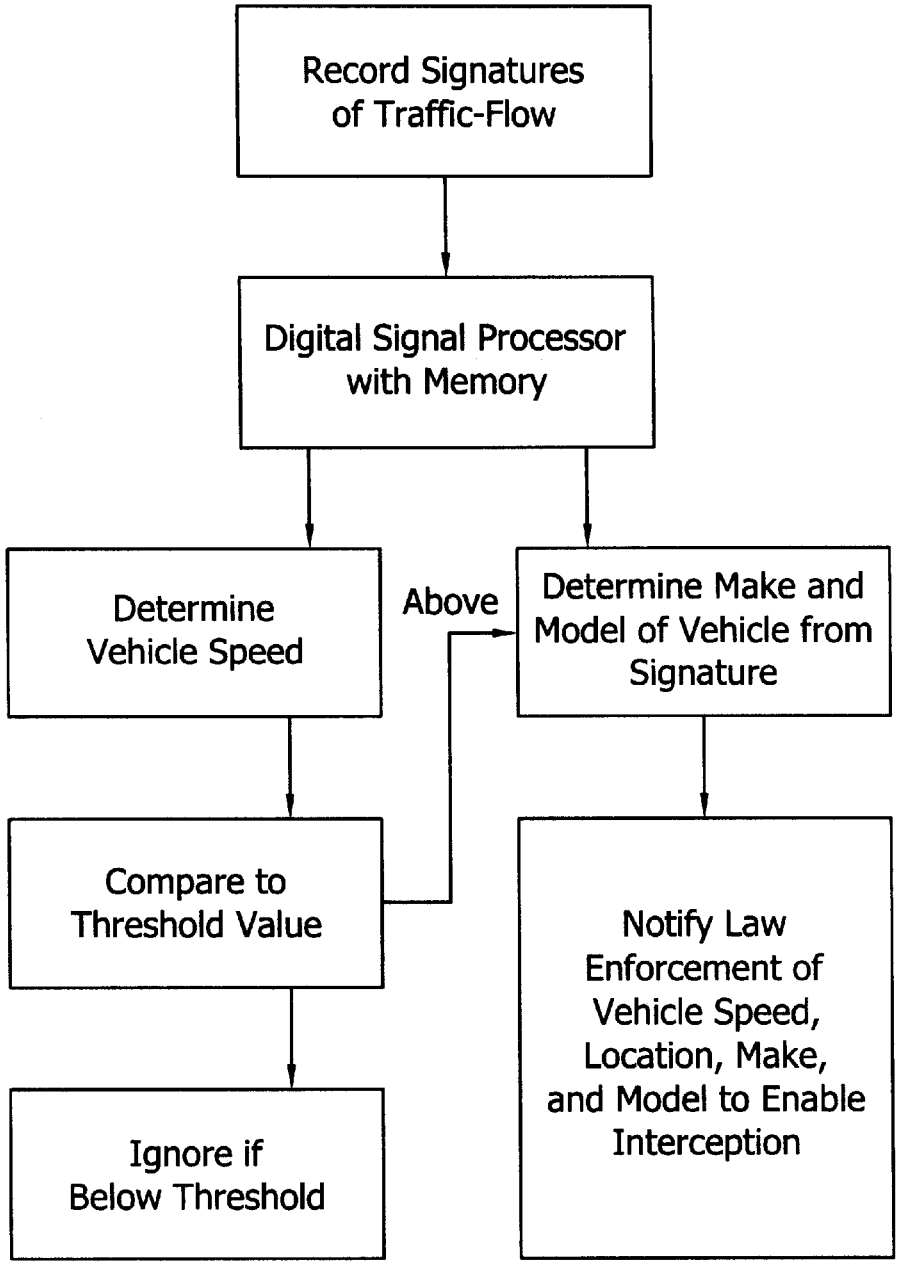
FIG. 13*a* is a block diagram of a typical traffic-flow monitoring application using inductive vehicle detectors of the present invention to screen traffic-flow for high-speed vehicles.
Figure 13B:
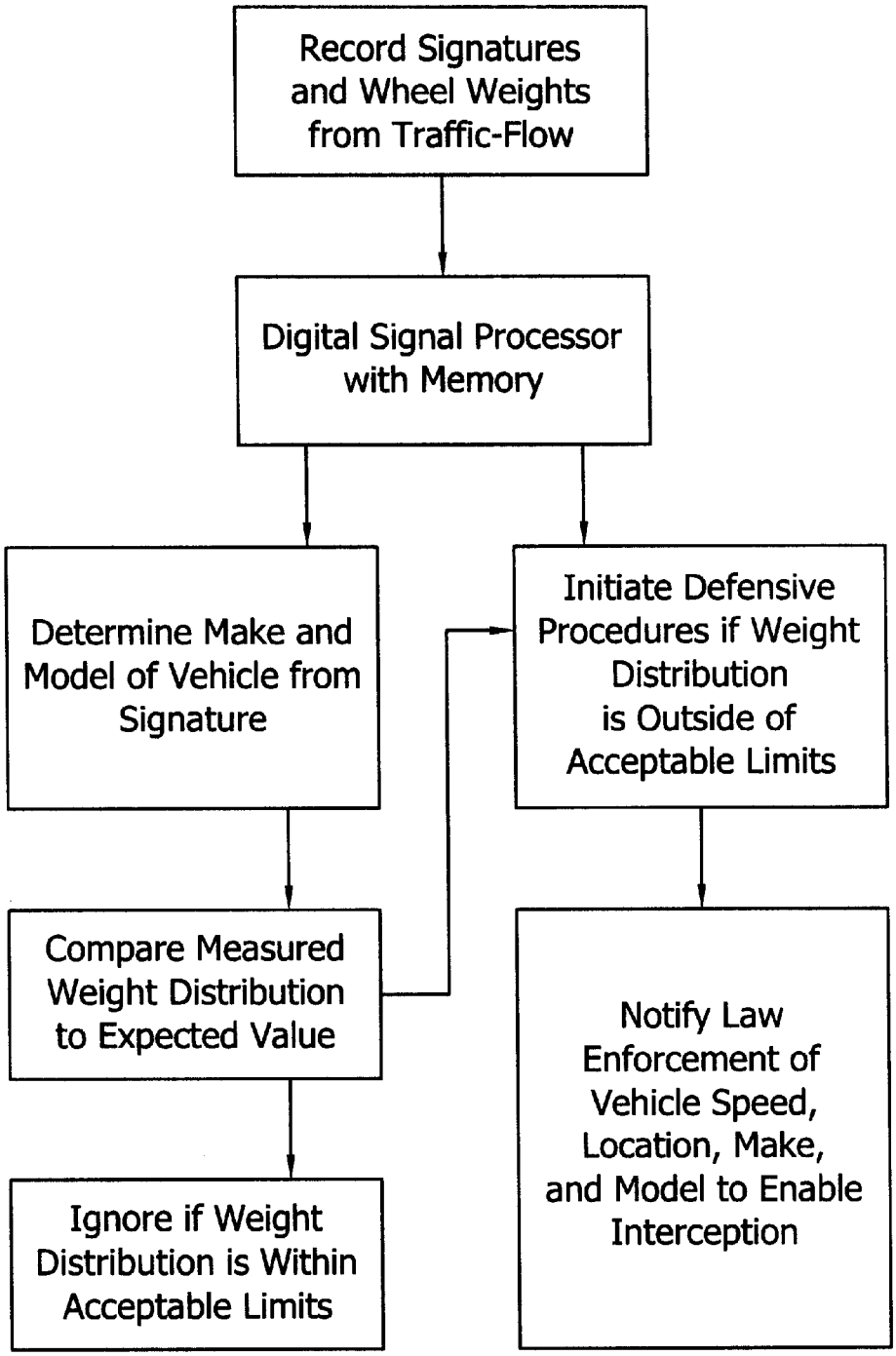
FIG. 13*b* is a block diagram of a typical traffic-flow monitoring application using inductive vehicle detectors of the present invention to screen traffic-flow for potential car-bombs.

In the preferred embodiment of the present invention the inductance of the wire-loops, 1 and 4, are measured by a "discrete" method rather than the "frequency-counter" method of the prior-art. FIGS. 10*a*–*f* illustrate the discrete method of inductance measurement where both LCR circuits, 9 and 10, are charged for a period of time using switches, 18 and 19, to connect a voltage source, 22, across the charging terminals, 20 and 21, of the two LCR circuits, 9 and 10 respectively, which causes the currents flowing through the wire-loops, 1 and 4, to rise approaching a limit which is determined by the resistance of the wire-loops, 16 and 17 respectively, the "on-state" resistance of the switches, 18 and 19, and the charging voltage 22; while the voltage on the capacitors, 7 and 8, approaches a similarly defined limit. Independent discharge oscillations, FIG. 10*a*, of the two LCR circuits, 9 and 10, are initiated upon turning off the switches, 18 and 19. FIG. 10*a* illustrates typical charge and discharge sequences which can be observed using an oscilloscope connected to either of terminals 20 or 21. The switches, 18 and 19, may be power MOSFETs; in which case the "on-state" resistance and gate capacitance parameters should be carefully matched between the two components preferably by selecting components which are inherently similar, or alternately by adding small trimming resistances to the circuit.

Each voltage measurement, or sample, which is taken while the LCR circuits, 9 and 10, are oscillating, is typically digitized by an analog-to-digital converter, FIGS. 11–27, which then provides the digital data as input to a digital signal processing (DSP) system, 28. Analog-to-digital converters are generally characterized by their finite precision; e.g., 8-bit precision, 12-bit precision, or 16-bit precision, etc. The variation of the inductance of the wire-loop, 1, is what is of interest to be measured and digitized by the analog-to-digital converter, 27. Since the maximum variation of this quantity ranges only between approximately 0.2% to 2% of the nominal inductance of the wire-loop, 1, a very high percentage of the useful precision of the analog-to-digital converter, 27, would be consumed to measure a predictable voltage, or common-mode voltage, if the decaying sinusoidal curve, FIG. 10*a,* were to be sampled directly. To avoid this undesirable loss of precision in the digitized inductance measurement, it is desirable to ignore the predictable majority, or common-mode voltage, of the decaying sinusoidal curve, FIG. 10*a,* to be measured. In the preferred embodiment of the present invention, the decaying sinusoidal curve, FIG. 10*a,* of the secondary LCR circuit, 10, is subtracted from the decaying sinusoidal curve, FIG. 10*a,* of the primary LCR circuit, 9, and then amplified by an op-amp, 11, configured as an instrumentation amplifier, 11–16, to produce a composite output sinusoid, FIGS. 10*c* and 10*d,* which represents substantially the amplified sum of the inductance differential between the wire-loops, 1 and 4, and the instantaneous electromagnetic noise being induced into the wire-loops, 1 and 4. Any difference in inductance between the two LCR circuits results in an accumulating phase-shift between the two oscillating sinusoids, and a less consequential amplitude-decay differential yielding a composite output sinusoid, FIG. 10*d,* having an amplitude which is substantially reflective of the amplified difference in inductance between the two LCR circuits.

Because the noise-floor of the instrumentation amplifier, 11–16, is the limiting factor for the signal-to-noise ratio of the detector, it is important to choose the lowest practical values for the resistors, 12–15, and a low-noise op-amp, 11; Analog Devices part number OP-37 is recommended. Optimal function is achieved when the configuration resistors, 12, 13, 14, and 15, are matched to high precision.

After the common-mode voltage has been removed by the instrumentation amplifier, 11–16, and the remainder amplified, one or more voltage measurements, or samples, FIGS. 10*e* and 10*f,* are taken from the amplifier output terminal, 16, while the LCR circuits, 9 and 10, are oscillating. A sample-and-hold amplifier, 23, is triggered by a control signal, FIG. 10*e,* at its logic input terminal, 24, and provides a stable voltage at its output terminal, 25. A band-pass filter, FIGS. 11–26, may be used to condition the composite output sinusoid, FIG. 10*d,* prior to sampling to improve signal-to-noise ratio.

This "discrete" method of measuring the inductance of the wire-loops, 1 and 4, requires only one charge-discharge cycle of the LCR circuits, 9 and 10, per measurement, and provides a result in a relatively short period of time with relatively high-precision by a method which is serially repeatable and substantially independent of preceding and succeeding measurements. The relatively short time between the charging of the LCR circuits and the sampling of the output sinusoid defines a favorably narrow time-aperture for the detector.

In the preferred embodiment of the present invention, the sinusoidal output signal, FIG. 10*d,* of the instrumentation amplifier, 11–16, is sampled only once per cycle, FIGS. 10*e* and 10*f.* However, in applications where it is desirable to further enhance the signal-to-noise ratio of each individual inductance measurement made, additional samples may be taken at any number of points on the output sinusoid, FIG. 10*d,* within the same induction measurement cycle. This plurality of samples may then be combined using any of the well known digital signal processing techniques to optimize the signal-to-noise ratio of the ultimate inductance measurement made by this process. Two digital signal processing techniques which are suitable for optimizing the signal-to-noise ratio of the ultimate inductance measurement given a plurality of samples digitized while the output sinusoid, FIG. 10*d,* oscillates are auto-correlation using the Fast-Fourier Transform (FFT), and Finite Impulse Response (FIR) digital filtering. Both of these digital signal processing techniques can be implemented in software given the availability of suitable micro-processing or digital signal processing hardware, 28, and software. These same digital signal processing techniques are also useful given a plurality of sequential inductance measurements to "smooth" the inductive vehicle signature.

In the preferred embodiment of the present invention, a plurality of successive induction measurements are recorded while an automotive vehicle over-passes the wire-loop of an inductive vehicle detector. This set of induction measurements is known collectively as the "inductive signature" of the vehicle, and represents an inductive profile substantially of the underside of the vehicle as a function of time as it over-passes the wire-loop of the vehicle detector. Because the instantaneous velocity of vehicles over-passing a typical wire-loop can vary over a wide range, the "inductive-time-signature" of a vehicle is generally not as useful for classification or identification of the vehicle as the "inductive-length-signature" of the vehicle. Therefore, it is often desirable to transform, or "normalize", the directly observable inductive-time-signature of the vehicle to the somewhat more useful inductive-length-signature of the vehicle. Nevertheless, the amplitude sequence of a set of characteristic points, especially inflection points, of an inductive-time-signature can be used for classification or identification of a vehicle without reference being made to the velocity or acceleration profile of the vehicle.

In the preferred embodiment of the present invention, the instantaneous velocity profile of a vehicle is measured during the time that it overpasses a wire-loop, 1, used for vehicle detection, and is used in transforming the recorded "inductive-time-signature" of the vehicle to the more useful "inductive-length-signature" of the vehicle. The instantaneous velocity profile of a vehicle is measured by deploying the wire-loop of a second vehicle detector substantially parallel to the first, and separated from the first by a known distance along the direction of vehicle travel. Two inductive-time-signatures are recorded for the vehicle from the two respective vehicle detectors, and the initial phase-shift between the two inductive-time-signatures is used along with the known distance between the two vehicle detectors to determine the initial vehicle velocity. Changes in the phase shift between the two inductive-time signatures are used along with the known distance between the two vehicle detectors to determine the acceleration profile of the vehicle during the time that it is over-passing the vehicle detectors. The initial velocity of the vehicle and the acceleration profile of the vehicle combine to define the instantaneous velocity profile of the vehicle. Many alternate approaches for deducing the velocity and acceleration profiles of the vehicle from the same available data are conceivable, and fall within the scope of the present invention.

In the preferred embodiment of the present invention, the wire-loops of two similar inductive vehicle detectors are configured parallel to each other a known distance apart. As a first approximation, sampled vehicles are assumed to be in constant forward motion with a linear acceleration profile during the sampling period. Both detectors are triggered simultaneously by the over-passing vehicle and are sampled at a fixed rate until the vehicle has been determined to have passed completely over the two detectors. Two substantially similar but phase-shifted inductive-time signatures are thus recorded for each over-passing vehicle and stored into two separate data buffers.

The initial step in processing the data into desired 'inductive-length-signatures' is to determine the magnitude of the initial and terminal phase shifts of the data. This is calculated by applying an arbitrary threshold value to the data and recording the number of leading and trailing baseline data points from each buffer. The difference in the number of leading and trailing baseline data points in each data buffer when related to the physical separation of the detectors and the sampling rate represents a direct measurement of the initial and terminal velocity of the vehicle as it passes over the detectors. The difference between the values of the initial and terminal velocities is the calculated acceleration of the vehicle during sampling. If linear acceleration is assumed then the mean velocity of the vehicle is used in conjunction with the number of data points in the 'inductive-time-signature' for the vehicle to determine its 'inductive-length'.

If a vehicle is accelerating during the sampling period then distortions in the inductive-time-signature due to this acceleration can be expected. These distortions may cause significant errors when comparing vehicle signatures and must be compensated for during the calculation of the 'inductive-length-signature'. In this way sets of data points collected under a variety of conditions may be accurately compared to determine a match. Employing existing mathematical algorithms for comparison purposes also requires that the number of data points in each set be equal while retaining all pertinent features of the data corresponding to the length of the vehicle.

These goals are accomplished by 'normalizing' the data to a fixed number of data points; 1024 in this example. Acceleration distortions are removed by reorganizing the inductive-time-signature into 32 sequential segments of unequal length representing equal length segments of the vehicle. For example, if a vehicle is noted to accelerate by 10% during sampling as it passes over the detectors then the number of data points representing sequential length segments of the vehicle in the inductive-time-signature will decrease proportionally in each successive segment with the final segment containing 10% fewer data points than the initial segment. Once the inductive-time-signature is divided into 32 segments of unequal data points, each segment is further 'normalized' to 32 data points for each equal length segment via standard linear interpolation techniques. The resulting 32 sets of 32 data points each are then recombined sequentially to create an 'inductive-length-signature' of 1024 data points representing the entire length of the vehicle. Other possibilities of compensating for acceleration induced distortions also exist including instantaneous phase-shift analysis, which may be accomplished during sampling, with alterations of the detector sampling rate in real-time. This method is preferred where non-linear acceleration profiles are anticipated.

With the distortions due to different velocity and acceleration profiles removed by the previously described normalization process, independently collected 'inductive lengths' and 'inductive-length-signatures' can then be compared in order to determine if two data sets constitute a match. While inductive lengths are stored as integer values and may be compared directly, statistical methods must be used for comparison of the 'inductive-length-signatures'. In the preferred embodiment of the present invention, the normalized 'inductive-length-signatures' are compared by calculating a value for the 'mean squared error' between the two data sets according to the formula:

$$MSE = \frac{1}{n}\sum_{i=1}^{n}\frac{(x_i - y_i)^2}{(x_i)}$$

If the 'mean squared error' between two 'inductive-length-signatures' is 0.05 (5% arbitrarily chosen value) or less they are considered to be a match. Other statistical methods, however, may be employed at this stage of analysis in order to determine if two signatures are essentially equivalent such a Linear Least Squared Analysis of the Fast Fourier Transform.

Once a correlation is determined to exist between two inductive-length-signatures with an acceptable degree of confidence, either the classification or identity of the vehicle is considered to be known within a finite degree of confidence and this information is available to be used as intended for a wide variety of applications which include parking-lot revenue control, car-bomb detection, traffic-law enforcement, and community security among many others.

Figures 14A, 14B:
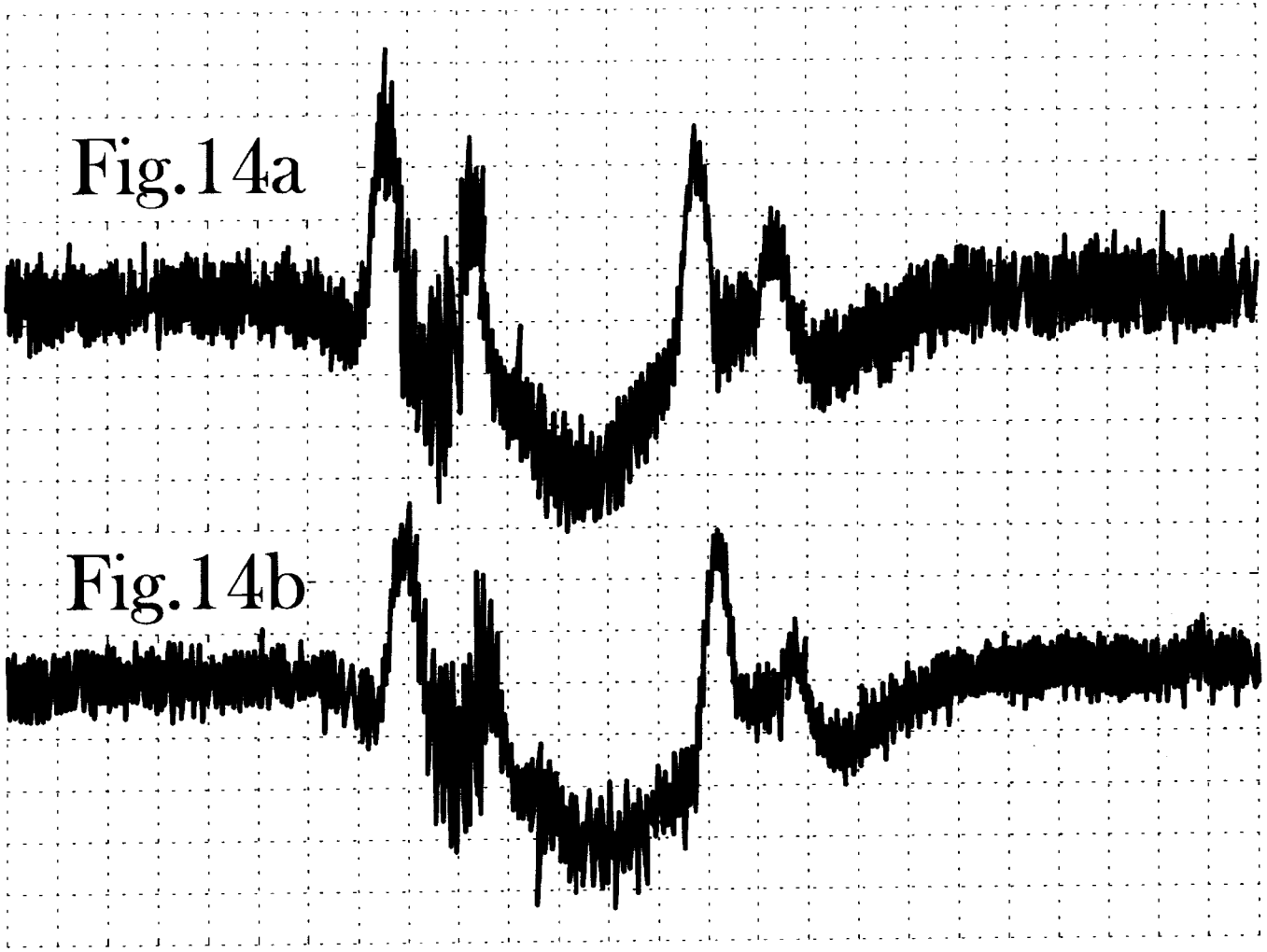
FIG. 14*a* represents a set of inductive-time-signature samples recorded from a Mercedes 300-CD passenger-car using a first wire-loop detector of the present invention.
FIG. 14*b* represents a set of phase-shifted inductive-time-signature samples recorded from the same Mercedes 300-CD passenger-car using a second wire-loop detector of the present invention which was positioned approximately 20 cm beyond the first wire-loop.

FIG. 14*a* represents a set of inductive-time-signature samples for a Mercedes 300-CD passenger-car using a first extended blade-type wire-loop and discrete-type detector circuitry using the best available field-data, but which was collected using an alternate embodiment of the present invention, not the preferred embodiment. The sample-rate for these samples is approximately 1500 samples/second.

FIG. 14*b* represents a set of inductive-time-signature samples for the same Mercedes 300-CD passenger-car using a second extended blade-type wire-loop which was positioned approximately 20 cm beyond the first wire-loop. The inductive-time-signature represented in FIG. 14*b* is substantially a phase-shifted version of that represented by FIG. 14*a,* as the two sets of samples were taken in alternating succession. Some differences in the character of the two signatures is apparent due to the fact that the contour of the pavement in which the two wire-loops were embedded is irregular. The phase-shift itself is indicative of the instantaneous velocity profile of the vehicle.

Figures 15A, 15B:
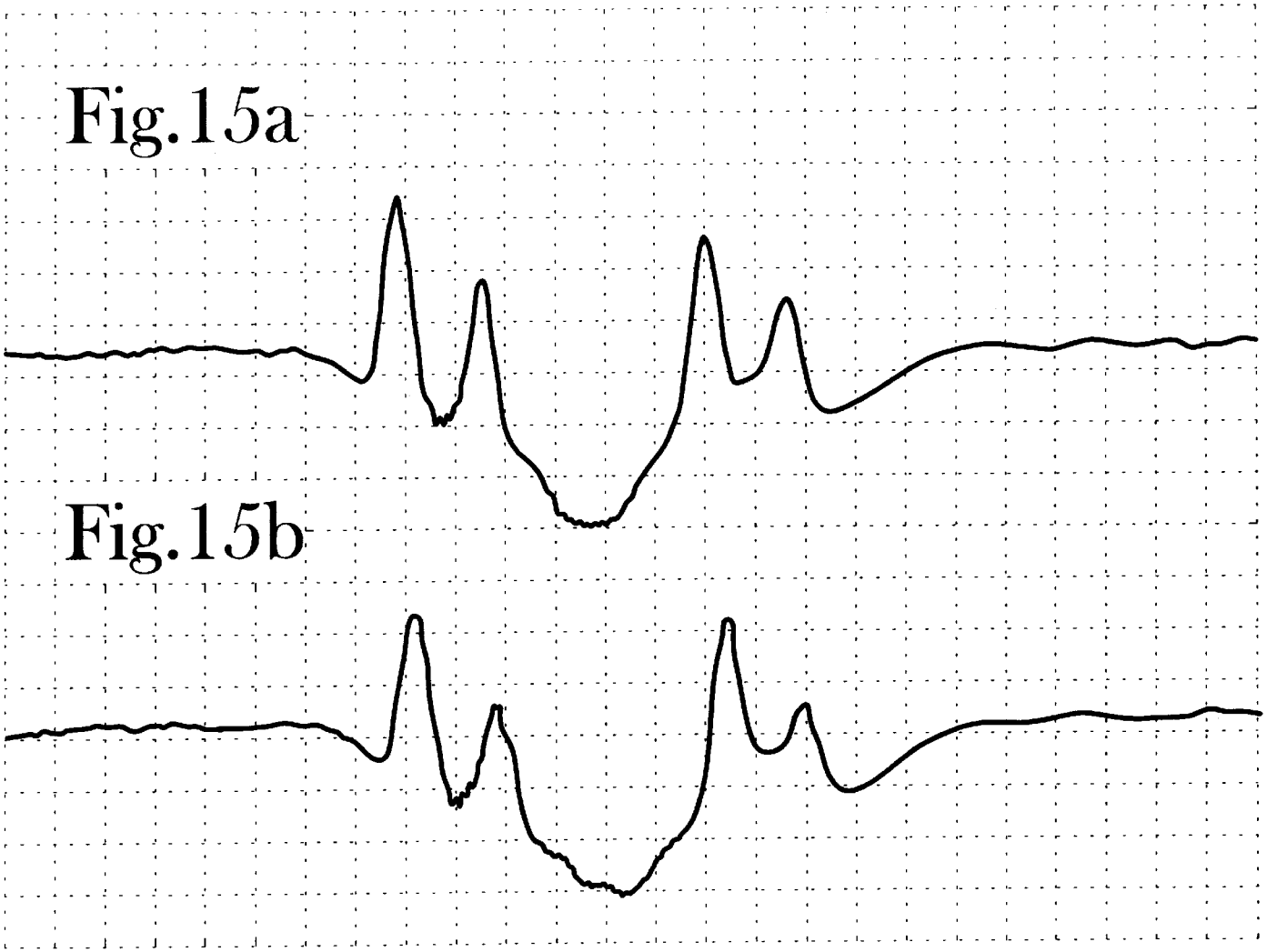
FIG. 15*a* represents the same set of inductive-time-signature samples of FIG. 14*a* which have been smoothed using a 100-point moving average.
FIG. 15*b* represents the same set of phase-shifted inductive-time-signature samples of FIG. 14*b* which have been smoothed using a 100-point moving average.

FIGS. 15*a* and 15*b* are "smoothed" versions of FIGS. 14*a* and 14*b*. In this case smoothing was accomplished by computing a 100-point moving average of the samples. This method of smoothing can be implemented in a computationally efficient manner and is recommended for real-time data collection purposes, e.g., detecting and recording signatures, but more computationally-intensive digital filtering is recommended for analysis of signature data once it has been collected.

Figures 16A, 16B:
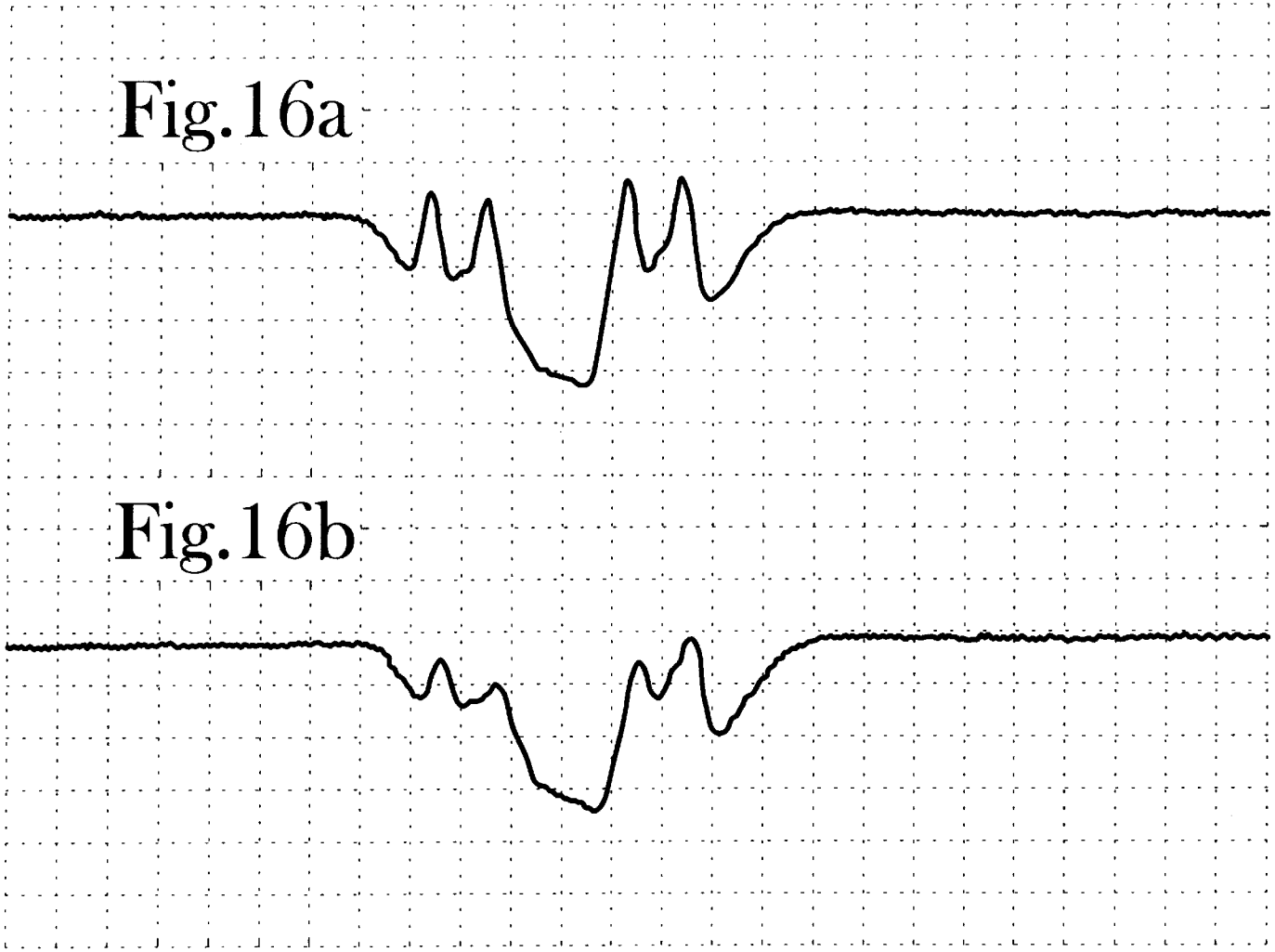
FIG. 16*a* represents a set of inductive-time-signature samples for a Saab 900 passenger-car using a first wire-loop detector of the present invention—smoothing was accomplished using a 100-point moving average.
FIG. 16*b* represents a set of phase-shifted inductive-time-signature samples for the same Saab 900 passenger-car using a second wire-loop detector of the present invention which was positioned approximately 20 cm beyond the first wire-loop—smoothing was accomplished using a 100-point moving average.

FIGS. 16*a* and 16*b* are smoothed versions of phase-shifted signatures for a Saab 900 passenger-car, and are provided for comparison to the other signatures presented to demonstrate the variability of the character of inductive signatures between passenger cars.

Figures 17A, 17B:
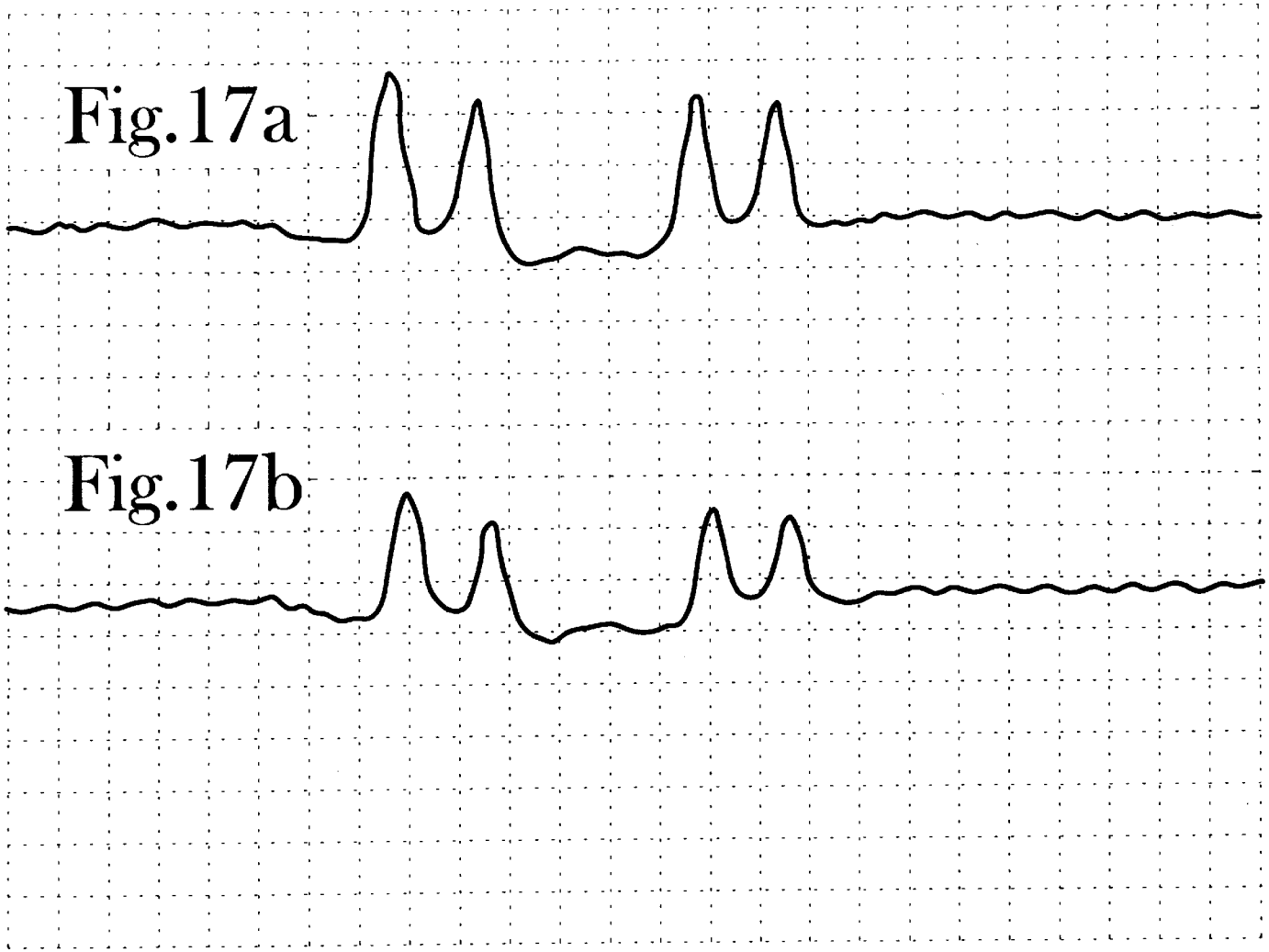
FIG. 17*a* represents a set of inductive-time-signature samples for a Ford Explorer truck using a first wire-loop detector of the present invention—smoothing was accomplished using a 100-point moving average.
FIG. 17*b* represents a set of phase-shifted inductive-time-signature samples for the same Ford Explorer truck using a second wire-loop detector of the present invention which was positioned approximately 20 cm beyond the first wire-loop—smoothing was accomplished using a 100-point moving average.

FIGS. 17*a* and 17*b* are smoothed versions of phase-shifted signatures for a Ford Explorer truck, and are provided for comparison to the other signatures presented to demonstrate the variability of the character of inductive signatures between passenger-cars and trucks.

In each of the signatures presented, four large peaks stand out. These peaks were produced by the metal associated with the wheels and steel-belted tires as they rolled over the blade-type wire-loop. From left to right, the first large peak in each signature corresponds to the left-front wheel of the over-passing vehicle. The second large peak corresponds to the right-front wheel. A similar set of peaks produced by the rear wheels is evident on the trailing end of the signatures. Variations in wheel-rims and tire specifications between vehicles of similar makes and models are useful in distinguishing between the inductive signatures produced by vehicles of the same make and model in applications such as parking-lot revenue control.

What is claimed is:

1. An inductive vehicle detector, for a traffic-lane having width, comprising:

at least one inductive sensor situated in the traffic-lane; and wherein said inductive sensor comprises:

a wire-loop having width which is at least as great as the width of the traffic-lane; and a means for measuring the inductance of the wire-loop.

2. The detector of claim 1 wherein the wire-loop is situated at an angle to the flow of traffic.

3. The detector of claim 2 wherein the wire loop has a common terminal and a charging terminal and intrinsic resistance, and wherein said means for measuring the inductance of the wire-loop comprises:

a capacitor having two terminals, wherein each terminal of the capacitor is connected to a corresponding terminal of the wire-loop, forming an LCR circuit which generates an output signal;

a means for generating a first and a second control signal;

a current source having a common terminal which is connected to the common terminal of the wire-loop, and a power terminal;

a first switching means for connecting and disconnecting the power terminal of said current source to the charging terminal of said LCR circuit in response to said first control signal;

a reference-signal generating means which generates a reference-signal;

an instrumentation amplifier means having first and second input terminals and an output terminal, wherein the output signal from said LCR circuit is connected to the first input terminal of the instrumentation amplifier, and said reference-signal is connected to the second input terminal of the instrumentation amplifier; and a sample-and-hold amplifier means having an analog input terminal, an analog output terminal, and a logic input terminal wherein said output terminal of said instrumentation amplifier means is connected to the analog input terminal, said second control signal is connected to said logic input terminal.

4. The detector of claim 3 wherein said reference-signal generating means comprises:

a second LCR circuit which generates said reference-signal.

5. The detector of claim 4 wherein said means for measuring the inductance of the wire-loop further comprises:

a band-pass filter which is interposed between the output terminal of said instrumentation amplifier means and the analog input terminal of said sample-and-hold amplifier means.

6. The detector of claim 5 wherein said means for measuring the inductance of the wire-loop further comprises:

an analog-to-digital converter means having an analog input terminal and a plurality of digital output terminals, and wherein the analog input terminal is connected to the analog output terminal of said sample-and-hold amplifier means; and a digital-signal-processing means having a plurality of digital input terminals which are connected to the respective digital output terminals of said analog-to-digital converter means.

7. An inductive vehicle detector, for a traffic-lane, comprising:

at least one inductive sensor situated in the traffic-lane; and wherein said inductive sensor comprises:

a vertically-oriented wire-loop; and a means for measuring the inductance of the wire loop.

8. The detector of claim 7 wherein the wire-loop is attached to a flexible forming body prior to situation into the traffic-lane and does not enclose pavement material.

9. The detector of claim 8 wherein the wire loop has a common terminal and a charging terminal and intrinsic resistance, and wherein said means for measuring the inductance of the wire-loop comprises:

a capacitor having two terminals, wherein each terminal of the capacitor is connected to a corresponding terminal of the wire-loop, forming an LCR circuit which generates an output signal;

a means for generating a first and a second control signal;

a current source having a common terminal which is connected to the common terminal of the wire-loop, and a power terminal;

a first switching means for connecting and disconnecting the power terminal of said current source to the charging terminal of said LCR circuit in response to said first control signal;

a reference-signal generating means which generates a reference-signal;

an instrumentation amplifier means having first and second input terminals and an output terminal, wherein the output signal from said LCR circuit is connected to the first input terminal of the instrumentation amplifier, and said reference-signal is connected to the second input terminal of the instrumentation amplifier; and a sample-and-hold amplifier means having an analog input terminal, an analog output terminal, and a logic input terminal wherein said output terminal of said instrumentation amplifier means is connected to the analog input terminal, said second control signal is connected to said logic input terminal.

10. The detector of claim 9 wherein said reference-signal generating means comprises:

a second LCR circuit which generates said reference-signal.

11. The detector of claim 10 wherein said means for measuring the inductance of the wire-loop further comprises:

a band-pass filter which is interposed between the output terminal of said instrumentation amplifier means and the analog input terminal of said sample-and-hold amplifier means.

12. The detector of claim 11 wherein said means for measuring the inductance of the wire-loop further comprises:

an analog-to-digital converter means having an analog input terminal and a plurality of digital output terminals, and wherein the analog input terminal is connected to the analog output terminal of said sample-and-hold amplifier means; and a digital-signal-processing means having a plurality of digital input terminals which are connected to the respective digital output terminals of said analog-to-digital converter means.

13. An inductive vehicle detector, for a traffic-lane, comprising: at least one inductive sensor situated in the traffic-lane; and wherein said inductive sensor comprises:

a primary wire-loop with fixed spatial dimensions and orientation;

a secondary wire-loop having substantially similar spatial dimensions and orientation as the primary wire-loop, but wherein at least one spatial dimension of the secondary wire-loop is significantly offset with respect to the primary wire-loop; and a means for measuring the inductance of the two wire-loops wherein the electromagnetic noise associated with both wire-loops combine and reduces the total electromagnetic noise associated with the two wire-loops.

14. The detector of claim 13 wherein the primary wire-loop and the secondary wire-loop are formed together on the same substrate which conducts heat between the two wire-loops whereby the thermal drift of the secondary wire-loop partially cancels the thermal-drift of the primary wire-loop.

15. The detector of claim 14 wherein the secondary wire-loop is positioned below the primary wire-loop and lies in substantially the same plane as the primary wire-loop.

16. The detector of claim 15 wherein the each wire-loop has an upper-horizontal leg and a lower-horizontal leg, and wherein the upper-horizontal leg of the secondary wire-loop abuts the lower-horizontal leg of the primary wire-loop.

17. The detector of claim 16 wherein the upper-horizontal leg of the secondary wire-loop and the lower-horizontal leg of the primary wire-loop are twisted together.

18. The detector of claim 17 wherein the primary wire-loop and the secondary wire-loop are charged by separate excitation circuits operated by common timing signals.

19. The detector of claim 18 wherein each wire-loop has a common terminal and a charging terminal and intrinsic resistance, and wherein said means for measuring the inductance of the wire-loop comprises:

a first and a second capacitor, each capacitor having two terminals, wherein each terminal of each capacitor is connected to a corresponding terminal of each respective wire-loop, forming a first and a second LCR circuit which generate a first and a second output signal respectively;

a means for generating a first and a second control signal;

a current source having a common terminal which is connected to the common terminals of each wire-loop, and a power terminal;

a first and a second switching means for connecting and disconnecting the power terminal of said current source to the charging terminals of each of said LCR circuits respectively in response to said first control signal;

an instrumentation amplifier means having first and second input terminals and an output terminal, wherein said first output signal from said first LCR circuit is connected to the first input terminal of the instrumentation amplifier, and said second output signal from said second LCR circuit is connected to the second input terminal of the instrumentation amplifier; and a sample-and-hold amplifier means having an analog input terminal, an analog output terminal, and a logic input terminal wherein said output terminal of said instrumentation amplifier means is connected to the analog input terminal, said second control signal is connected to said logic input terminal.

20. The detector of claim 19 wherein said means for measuring the inductance of the wire-loop further comprises:

a band-pass filter which is interposed between the output terminal of said instrumentation amplifier means and the analog input terminal of said sample-and-hold amplifier means.

21. The detector of claim 20 wherein said means for measuring the inductance of the wire-loop further comprises:

an analog-to-digital converter means having an analog input terminal and a plurality of digital output terminals, and wherein the analog input terminal is connected to the analog output terminal of said sample-and-hold amplifier means; and a digital-signal-processing means having a plurality of digital input terminals which are connected to the respective digital output terminals of said analog-to-digital converter means.

* * * * *